US008382092B2

(12) United States Patent
Meier et al.

(10) Patent No.: US 8,382,092 B2
(45) Date of Patent: Feb. 26, 2013

(54) DUAL HOPPER ASSEMBLY

(75) Inventors: James R. Meier, Minneapolis, MN (US); Jeff Stangler, Bloomington, MN (US); Chad Johnson, Shakopee, MN (US)

(73) Assignee: HID Global Corporation, Irvine, CA (US)

( * ) Notice: Subject to any disclaimer, the term of this patent is extended or adjusted under 35 U.S.C. 154(b) by 0 days.

(21) Appl. No.: 13/496,399

(22) PCT Filed: Sep. 17, 2010

(86) PCT No.: PCT/US2010/049304
§ 371 (c)(1),
(2), (4) Date: Mar. 15, 2012

(87) PCT Pub. No.: WO2011/035138
PCT Pub. Date: Mar. 24, 2011

(65) Prior Publication Data

US 2012/0175836 A1 Jul. 12, 2012

Related U.S. Application Data

(60) Provisional application No. 61/243,674, filed on Sep. 18, 2009.

(51) Int. Cl.
*B65H 5/22* (2006.01)
*B65H 83/00* (2006.01)
*B65H 85/00* (2006.01)

(52) U.S. Cl. ..... 271/3.14; 271/4.08

(58) Field of Classification Search ..... 271/9.04, 271/9.05, 9.07, 9.11, 3.14, 4.08
See application file for complete search history.

(56) References Cited

U.S. PATENT DOCUMENTS 4,053,152 A * 10/1977 Matsumoto ..... 271/9.07
5,268,705 A 12/1993 Dreinhoff et al.
5,669,724 A 9/1997 Kato
5,762,431 A 6/1998 Pawelka et al.
6,069,642 A 5/2000 Isobe
6,135,438 A 10/2000 Newman et al.
(Continued)

FOREIGN PATENT DOCUMENTS

JP 55123833 A * 9/1980
JP 62088737 A * 4/1987
(Continued)

OTHER PUBLICATIONS

Communication pursuant to Rules 161(1) and 162 EPC from corresponding European Patent Application No. 10757907.0, mailed Apr. 25, 2012.

(Continued)

*Primary Examiner* — David H Bollinger
(74) *Attorney, Agent, or Firm* — Westman, Champlin & Kelly, P.A.

(57) ABSTRACT

Embodiments of the invention are directed to a dual hopper assembly for use in a credential processing device, a credential processing device that includes a dual hopper assembly, and methods of feeding substrates in a credential processing. One embodiment of the dual hopper assembly comprises an upper hopper configured to support one or more card substrates, a lower hopper configured to support one or more card substrates and an input feed roller. The input feed roller is positioned between the upper and lower hoppers and is movable between a first position, in which the input feed roller engages a bottom substrate supported in the upper hopper, and a second position, in which the input feed roller is displaced from the bottom substrate.

19 Claims, 11 Drawing Sheets

U.S. PATENT DOCUMENTS

| | | | |
|---|---|---|---|
| 6,446,832 | B1 | 9/2002 | Holec et al. |
| 6,554,512 | B2 | 4/2003 | Heno et al. |
| 2006/0151935 | A1 | 7/2006 | Liatard et al. |
| 2007/0023992 | A1 | 2/2007 | Ohta et al. |

FOREIGN PATENT DOCUMENTS

| | | | | |
|---|---|---|---|---|
| JP | 63017742 | A | * | 1/1988 |
| JP | 63262351 | A | * | 10/1988 |
| JP | 04365730 | A | * | 12/1992 |
| WO | 02/087891 | A1 | | 11/2002 |
| WO | 02/087892 | A1 | | 11/2002 |
| WO | 2008010320 | A1 | | 1/2008 |
| WO | 2011035138 | A1 | | 3/2011 |

OTHER PUBLICATIONS

International Search Report and Written Opinion from corresponding International Application No. PCT/US2010/049304, mailed Dec. 17, 2010.

* cited by examiner

DUAL HOPPER ASSEMBLY

CROSS-REFERENCE TO RELATED APPLICATION

This Application is a Section 371 National Stage Application of International Application No. PCT/US2010/049304, filed Sep. 17, 2010 and published as WO 2011/035138 A1 on Mar. 24, 2011, and claims the benefit of U.S. Provisional Application Ser. No. 61/243,674, filed Sep. 18, 2009 under 35 U.S.C. §119(e). Each of the above-referenced applications are incorporated herein by reference in their entirety.

Credentials include identification cards, driver's licenses, passports, and other documents. Such credentials are formed from credential or card substrates including paper substrates, plastic substrates, cards and other materials. Such credentials generally include printed information, such as a photo, account numbers, identification numbers, and other personal information. A secure overlaminate may also be laminated to the surfaces of the credential substrate to protect the surfaces from damage and, in some instances, provide a security feature (e.g., hologram). Additionally, credentials can include data that is encoded in a smartcard chip, a magnetic stripe, or a barcode, for example.

Such credentials are generally formed using a credential processing device that processes a credential substrate to produce the credential. Such processes generally include a printing process, a laminating process, a data reading process, a data writing process, and/or other process used to form the desired credential. These processes are performed by processing components of the device, such as a print head, a laminating roller, a data encoder (e.g., smart card encoder, magnetic stripe encoder, etc.) or other processing component that are in line with a processing path, along which individual card substrates are fed by a transport mechanism.

The transport mechanism generally includes feed rollers or pinch roller pairs that receive individual substrates from a substrate supply and feed the substrates along the processing path. The substrate supply generally includes a separate motorized feed mechanism that typically feeds individual substrates from, for example, a single stack of substrates, to the feed rollers of the transport mechanism.

It is often necessary to process different types of card substrates depending on the desired credential. This often requires the user of the credential processing device to periodically replace one type of card substrate contained in the supply with another type of card substrate that is required to produce the desired credential.

Embodiments of the present invention provide solutions to these and other problems, and offer other advantages over the prior art.

SUMMARY

Embodiments of the invention are directed to a dual hopper assembly for use in a credential processing device, a credential processing device that includes a dual hopper assembly, and methods of feeding substrates in a credential processing device. One embodiment of the dual hopper assembly comprises an upper hopper configured to support one or more card substrates, a lower hopper configured to support one or more card substrates and an input feed roller. The input feed roller is positioned between the upper and lower hoppers and is movable between a first position, in which the input feed roller engages a bottom substrate supported in the upper hopper, and a second position, in which the input feed roller is displaced from the bottom substrate.

One embodiment of the credential processing device comprises a transport mechanism, a processing component, and a dual hopper assembly. The transport mechanism feeds individual card substrates along a processing path. The processing component performs a process on card substrates fed by the transport mechanism. The dual hopper assembly comprises an upper hopper configured to support one or more substrates, a lower hopper configured to support one or more substrates and an input feed roller. The input feed roller is positioned between the upper and lower hoppers and is movable between first and second positions relative to the processing path. The input feed roller is configured to feed a bottom substrate supported in the upper hopper along the processing path when in the first position, and the input feed roller is displaced from the bottom substrate when in the second position.

One embodiment of the method comprises providing a credential processing device comprising a transport mechanism, a processing component and a dual hopper assembly. The transport mechanism is configured to feed individual card substrates along a processing path. The processing component is configured to perform a process on card substrates fed by the transport mechanism. The dual hopper assembly comprises an upper hopper supporting one or more card substrates, a lower hopper and an input feed roller. Also in the method, the input feed roller is lowered relative to the processing path to a first position, in which the input feed roller engages a bottom substrate supported in the upper hopper. The bottom substrate is then fed along the processing path using the input feed roller.

DETAILED DESCRIPTION

Figure 1:
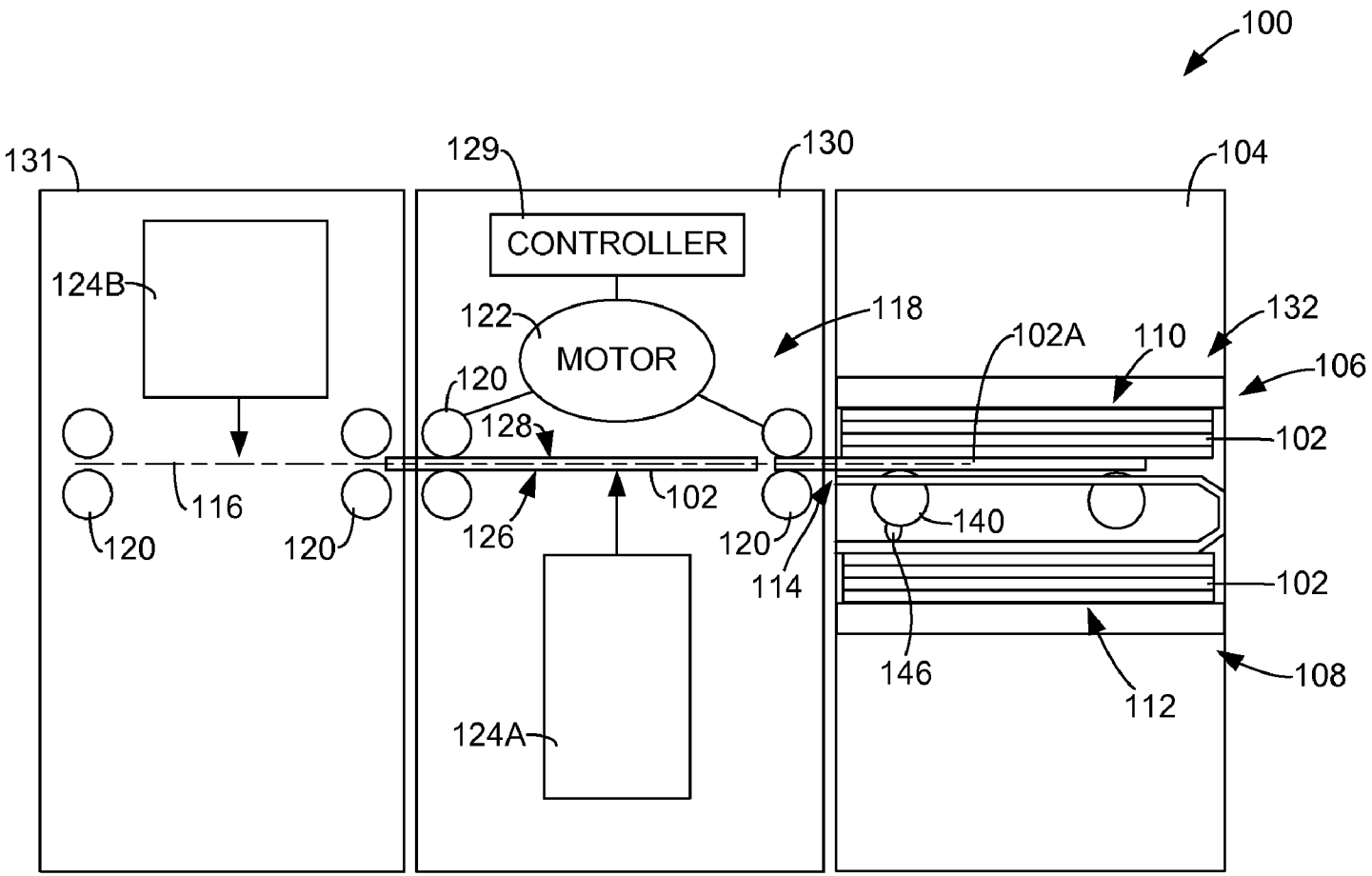
FIG. 1 is a schematic illustration of an exemplary credential processing device in accordance with embodiments of the invention.

Embodiments of the invention include a dual hopper assembly for use in a credential processing device, a credential processing device that includes the dual hopper assembly and methods of feeding substrates in a credential processing device. In accordance with one or more embodiments, the dual hopper assembly includes features for feeding credential substrates from two different input substrate hoppers using a single input feed roller. Under another embodiment, the dual hopper assembly includes features for feeding credential substrates from an input hopper and discharging substrates to an output substrate hopper. In one embodiment, the dual hopper assembly moves relative to the processing path, along which individual substrates are fed for processing. These and other features and benefits that characterize embodiments of the invention will be apparent upon reading this detailed description and review of the associated drawings. Elements in the drawings having the same or similar label correspond to the same or similar elements.

FIG. 1 is a simplified diagram of a credential processing device 100 in accordance with embodiments of the invention. The device 100 generally operates to process credential substrates 102 to form a credential product. As used herein, "substrate," "card" or "card substrate" includes substrates used to form credentials, such as identification cards, driver's licenses, passports, and other credentials. Exemplary substrates include paper substrates other than traditional paper sheets used in copiers or paper sheet printers, plastic substrates, rigid and semi-rigid card substrates and other materials.

One embodiment of the device 100 includes a dual hopper assembly 104 that includes an upper hopper 106 and a lower hopper 108. In one embodiment, the upper hopper 106 is configured to support one or more substrates 102 in a stack 110 and the lower hopper 108 is configured to support one or more substrates 102 in a stack 112. In one embodiment, the dual hopper assembly 104 is configured to feed individual substrates 102 from either the upper hopper 106 or the lower hopper 108 through a substrate port 114 that is aligned with a processing path 116. In one embodiment of the dual hopper assembly 104, the upper hopper 106 is configured to feed substrates 102 through the substrate port 114 and the lower hopper 108 is configured to receive substrates 102 fed through the substrate port 114.

One embodiment of the device 100 includes a card transport mechanism 118 that is configured to receive substrates 102 fed through the substrate port 114 and feed the individual substrates 102 along the processing path 116. One exemplary embodiment of the transport mechanism 118 comprises feed rollers or pinch roller pairs 120 that are driven by a motor 122.

One embodiment of the device 100 includes one or more processing components 124, such as component 124A and 124B, shown in FIG. 1. In one embodiment, each of the processing components 124 is configured to perform a process on a card substrate 102 that is presented to the card processing component 124 along the path 116 by the transport mechanism 118. Exemplary processes performed by the one or more processing components 124 include a printing process, in which an image containing text and/or graphics is printed to a surface of the substrate, a laminating process, in which an overlaminate film is applied to a surface of the substrate, a data reading or writing process, in which data is read from or written to the substrate (e.g., a memory chip, magnetic stripe, or other data holding component of the substrate), a substrate inverting process, in which the substrate is rotated or flipped to allow for processing of both sides of the substrate, or other process used to transform the substrate into a credential product. Accordingly, embodiments of the one or more processing components 124 include a print head, a laminating roller, a data encoding device (i.e., a memory reading or writing device, a magnetic stripe writer or reader, etc.), a card flipper or rotator, and/or other component used to perform a process on a substrate to form a credential.

One embodiment of the card processing component 124 includes a print head for printing an image to a surface of the card substrate 102. The print head can be used to either directly print the image to the surface, such as a bottom surface 126 or a top surface 128, or print an image to an image transfer film, from which the printed image is transferred to the bottom surface 126 or the top surface 128 of the card substrate 102, in accordance with conventional techniques. Such a print head generally utilizes a print consumable, such as ink or a print ribbon.

Another embodiment of the card processing component 124 comprises a laminating roller configured to laminate an overlaminate film to the bottom surface 126 or the top surface 128 of the card substrate 102, in accordance with conventional lamination techniques.

In accordance with another embodiment, the card processing component 124 includes a data reader/writer that is configured to read data from and/or write data to the card substrate 102. In one embodiment, the data writer is configured to read data from and/or write data to a memory chip embedded in the card substrate 102, to read data from and/or write data to a magnetic stripe of the card substrate 102, or read data from and/or write data to another component of the card substrate 102.

In one embodiment, the device 100 includes a controller 129 that is generally configured to control the operations of the device 100 including the motor 122 driving the feed rollers 120 of the transport mechanism 118, and the one or more card processing components 124 to process individual card substrates 102 fed from the dual hopper assembly 104 responsive to a card processing job. The card processing job generally comprises instructions generated by a card processing application, which is typically executed on a host computer, for example. One embodiment of the controller 129 comprises one or more processors and memory used execute the instructions of the card processing job through the control of the components of the device 100.

In one embodiment, the device 100 is a modular device including two or more modular components, such as modular components 130 and 131, each having different processing components 124A and 124B for performing different processing steps on a substrate. For instance, modular component 130 may be a print section having a print head processing component 124A, and modular component 131 include a laminating processing component 124B. In one embodiment, the dual hopper assembly 104 is a modular component that attaches to the modular component 130. In other embodiments, the credential processing device 100 can be a single unit for containing one or more processing components 124 for processing a credential substrate 102.

Figure 2:
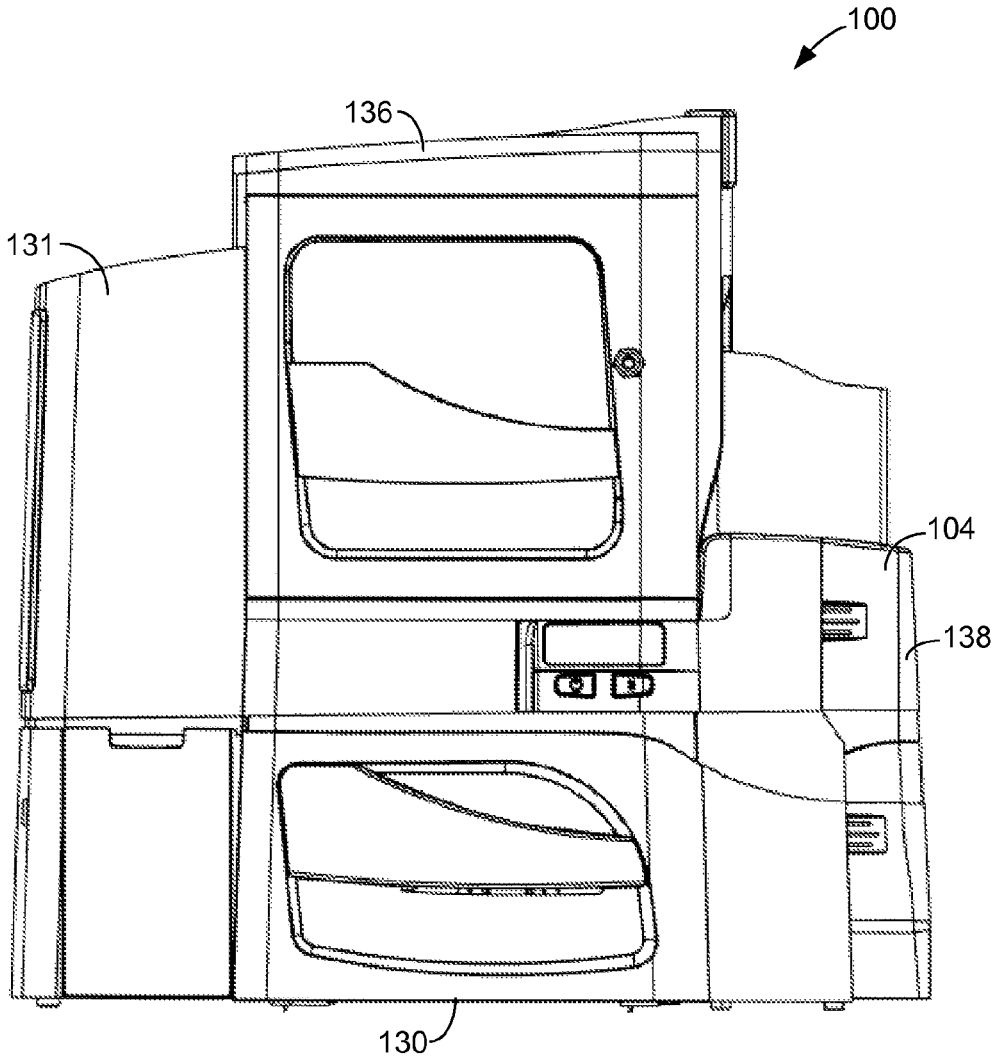
FIG. 2 is a front elevation view of an exemplary credential processing device in accordance with one or more embodiments of the invention.

FIG. 2 is a front elevation view of an exemplary credential processing device 100 in a modular form that includes a print section 130, the dual hopper assembly 104, a card flipper section 131 and a laminating section 136. The dual hopper assembly 104 attaches at one end of the device 100 and facilitates the feeding of supplies for processing by the various processing sections of the device 100.

Figure 3:
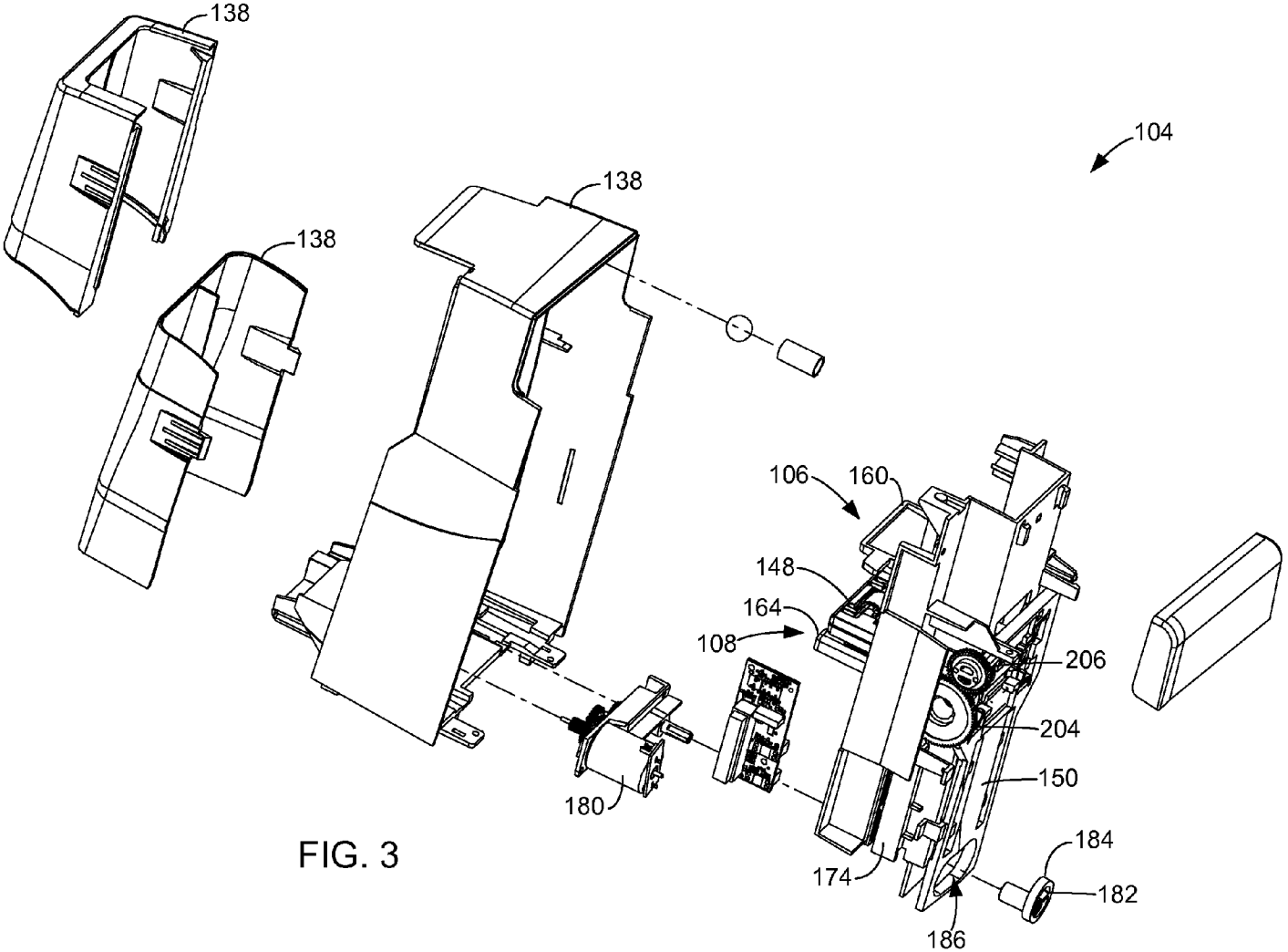
FIG. 3 is an exploded isometric view of a dual hopper in accordance with embodiments of the invention.
Figure 4:
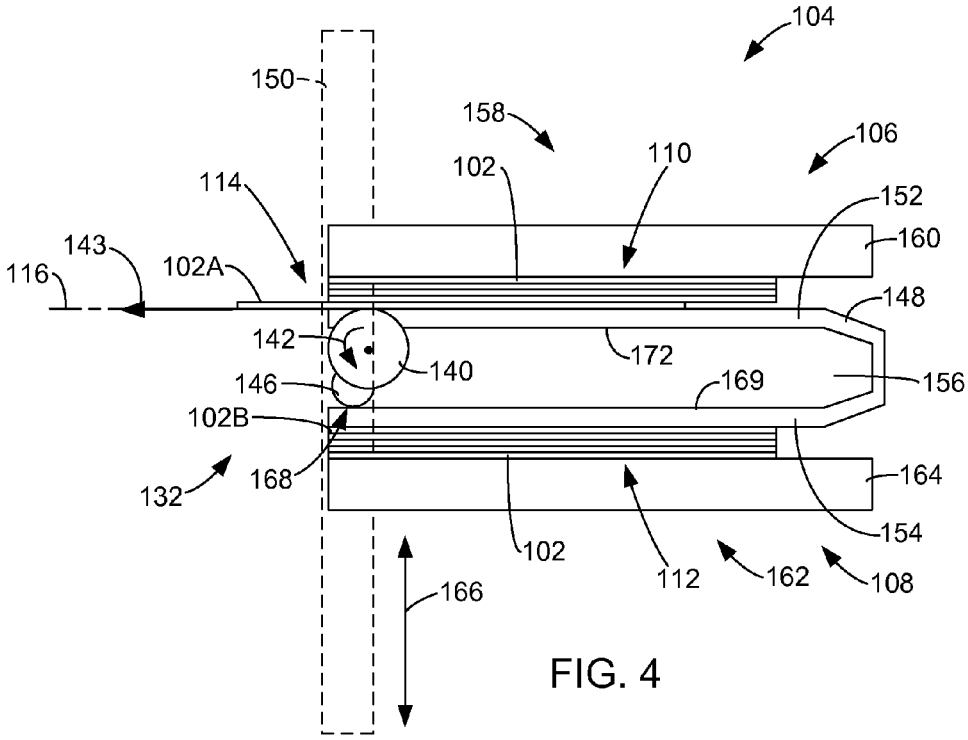
FIG. 4 is a simplified side view of portions of a dual hopper assembly in a first position in accordance with embodiments of the invention.
Figure 5:
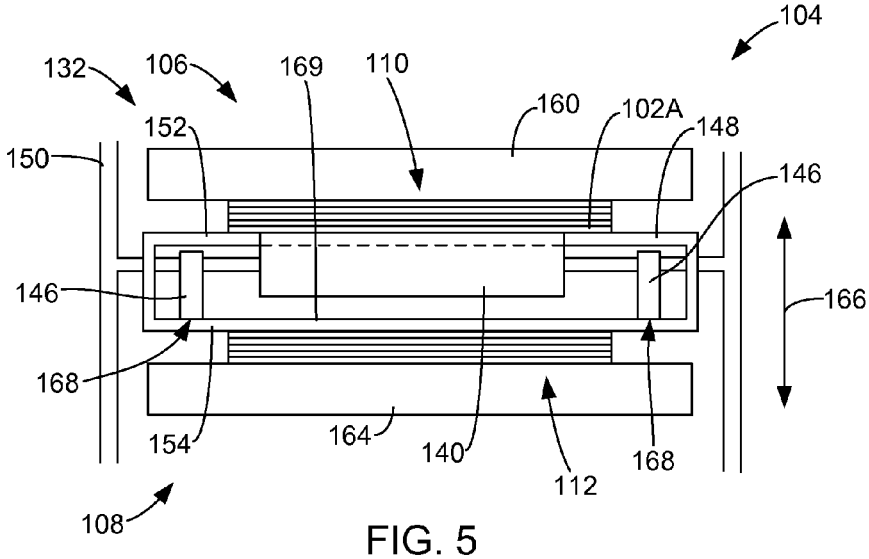
FIG. 5 is a simplified front view of the portions of the dual hopper assembly illustrated in FIG. 4.
Figure 6:
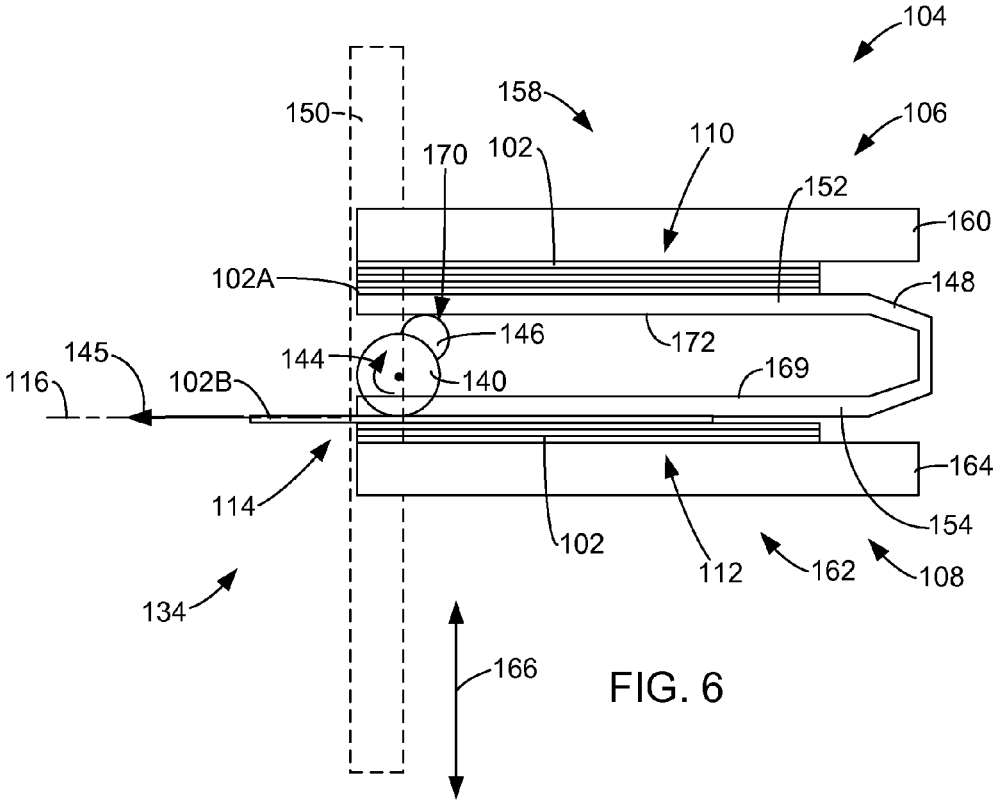
FIG. 6 is a simplified side view of portions of a dual hopper assembly in a second position in accordance with embodiments of the invention.
Figure 7:
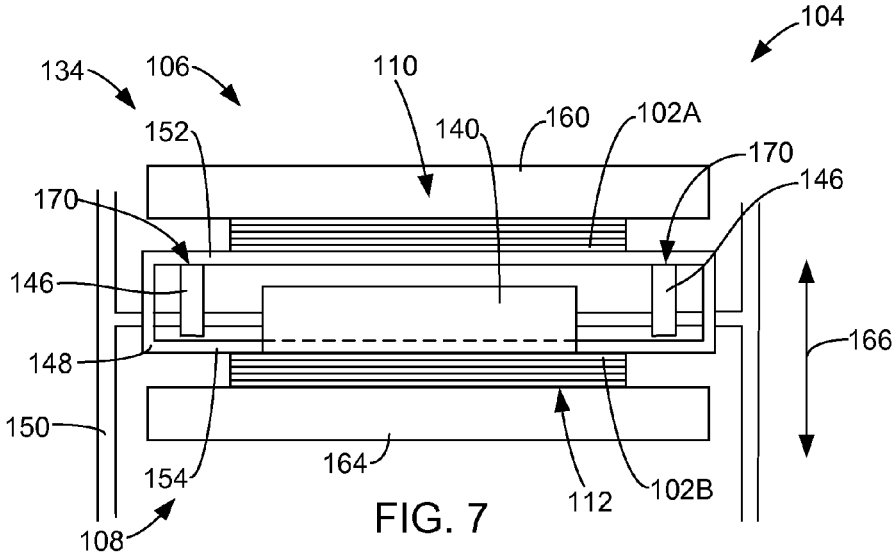
FIG. 7 is a simplified front view of the portions of the dual hopper assembly illustrated in FIG. 6.

An initial set of embodiments of the dual hopper assembly 104 will be described with reference to FIGS. 1-7. FIG. 3 illustrates an exploded isometric view of a dual hopper assembly 104 in accordance with embodiments of the invention. FIGS. 4 and 5 respectively are simplified side and front views of portions of a dual hopper 102 in a first position, in accordance with embodiments of the invention. FIGS. 6 and 7 respectively are simplified side and front views of portions of a dual hopper 102 in a second position, in accordance with embodiments of the invention.

In one embodiment, the dual hopper assembly 104 includes exterior housing components 138 covering the upper and lower hoppers 104 and 106. In one embodiment, the dual hopper assembly 104 is configured to feed substrates 102 from the upper and lower stacks 110 and 112 of the upper and lower hoppers 104 and 106. In one embodiment, this feeding of substrates from the upper and lower hoppers 104 and 106 is achieved using a single input feed roller 140 that is generally positioned between the upper and lower hoppers 106 and 108. In one embodiment, the input feed roller is movable relative to the processing path 116 to selectively feed a bottom card 102A from the upper hopper 106 (shown in FIG. 1), or a top card 102B from the lower hopper 108, through the substrate port 114 and to the transport mechanism 118 for feeding along the processing path 116.

In one embodiment, the dual hopper assembly 104 has a first position 132, in which it feeds the bottom card 102A from the upper hopper 106 through the port 114 to the transport mechanism 118, as illustrated in FIG. 1 and FIGS. 4 and 5. In one embodiment, the dual hopper assembly 104 has a second position 134, in which it feeds the top card 102B from the lower hopper unit 106 through the port 114 and to the transport mechanism 118, as illustrated in FIGS. 6 and 7.

In one embodiment, the input feed roller 140 is placed in contact with the bottom card substrate 102A of the stack 110 card substrates 102 supported in the upper hopper 106, and the input feed roller 140 is displaced from the upper card substrate 102B the stack 112 supported in the lower hopper 108 when in the first position 132, as shown in FIGS. 1, 4 and 5. When in the first position 132, the input feed roller 140 is motor driven in the direction indicated by arrow 142 that drives the bottom card 102A through the port 114 and to the transport mechanism 118 for feeding along the processing path 116, as indicated by arrow 143.

In one embodiment, the input feed roller 140 is placed in contact with the top card 102B of the stack 112 supported in the lower hopper 108 and is displaced from the bottom card 102A of the stack 110 supported in the upper hopper 106 when in the second position 134, as shown in FIGS. 6 and 7. When in the second position 134, the input feed roller 140 is motor driven in the direction indicated by arrow 144 that drives the top card 102B through the port 114, as indicated by arrow 145, and to the transport mechanism 118 for feeding along the processing path 116.

In one embodiment, the dual hopper assembly 104 includes the input feed roller 140, one or more cams 146, a substrate engaging table 148 and a sliding bracket 150. In one embodiment, the input feed roller 140, the one or more cams 146 and the substrate engaging table are attached to, or supported by the sliding bracket 150. In one embodiment, the table 148 comprises a top table member 152 and a bottom table member 154 that are separated by a gap 156. In one embodiment, the cams 146, which are displaced from the input feed roller 140 (FIGS. 5 and 7) are configured to rotate or pivot about the axis of the input feed roller 140 independent of the rotation of the input feed roller 140. In accordance with another embodiment, the cams 146 may rotate or pivot about an axis supported by the bracket 150 that is different from the axis of rotation of the roller 140.

In one embodiment, the upper hopper 106 includes a biasing mechanism 158 that applies a bias force to the stack of substrates 110 supported by the upper hopper 106 that directs the stack 110 toward the top table member 152 and the input feed roller 140. In one embodiment, the biasing mechanism 158 comprises a member 160 that engages the stack 110 and is biased toward the table member 152 and the input feed roller 140 using a spring, a weight or other suitable technique. In one embodiment, the lower hopper 108 includes a biasing mechanism 162 that applies a bias force to the lower stack 112 of substrates 102 supported in the lower hopper 108 that directs the stack 112 toward the bottom table member 154 and the input feed roller 140. In one embodiment, the biasing mechanism 162 includes a member 164 that is biased toward the table member 154 and the input feed roller 140 using a spring or other suitable technique.

In one embodiment, the sliding bracket 150 is movable in a vertical direction as illustrated by arrow 166 in FIGS. 4-7. In one embodiment, the input feed roller 140 and the table 148 also move along the direction 166 relative to the processing path 116. In one embodiment, this movement of the input feed roller 140 and the table 148 is responsive to movement of the sliding bracket 150. In one embodiment, the substrate engaging table 148 is also movable relative to input feed roller 140 along the direction 166.

In one embodiment, the dual hopper assembly 104 is set to the first position 132 by lowering the sliding bracket 150, the input feed roller 140, and the table 148 relative to the processing path 116 along the direction 166. In one embodiment, the input feed roller 140 is lowered to a position that places a majority of the roller 140 below the processing path 116, as shown in FIG. 4. In one embodiment, the lowering of the sliding bracket 150 causes the cams 146 to rotate about an axis, such as the axis of rotation of the input feed roller 140, and direct a surface 168 of the cams 146 to push against a lower inner surface 169 of the bottom table member 154 of the substrate engaging table 148. The force applied to the surface 169 by the cams 146 pushes the bottom table member 154 downward in the direction 166 relative to the input feed roller 140. This downward movement of the bottom table member 154 pushes the lower stack 112 of credential substrates 102 downward and displaces the top substrate 102B from the input feed roller 140. Additionally, the top table member 152 is lowered relative to the input feed roller 140 responsive to the lowering of the table 148 by the cams 146. This causes the input feed roller 140 to engage the bottom substrate 102A of the upper hopper 106 of credential substrates through, for example, an opening in the top table member 152. The rotation of the input feed roller 140 in the direction 142 drives the bottom substrate 102A through the port 114 where it can be received by the transport mechanism 118 for feeding along the processing path 116. The dual hopper assembly 104 may remain in the first position 132 to feed additional substrates 102 from the stack 110 supported in the upper hopper 106.

The transition of the dual hopper assembly 104 from the first position 132 to the second position 134 involves raising the sliding bracket 150, the input feed roller 140, and the substrate engaging table 148 in the direction 166 relative to the processing path 116, as shown in FIGS. 6 and 7. In one embodiment, the input feed roller 140 is raised to a position that places a majority of the roller 140 above the processing path 116. Additionally, the substrate engaging table 148 is raised relative to the input feed roller through the rotation of the cams 146 about the axis of rotation of the input feed roller 140. In one embodiment, the raising of the sliding bracket 150 causes the cams 146 to rotate or pivot about an axis, such as the axis of the input feed roller 140, and a surface 170 to push against an upper inner surface 172 of the top table member 152 of the substrate engaging table 148 to push the engaging table 148, or at least the table member 152, upward in the direction 166 relative to the input feed roller 140. This upward movement of the top table member 152 pushes the upper stack 110 of credential substrates 102 upward and displaces the bottom substrate 102A from the input feed roller 140, as shown in FIGS. 6 and 7.

Additionally, the bottom table member 154 is raised relative to the input feed roller 140 responsive to the raising of the table 148 by the cams 146. This causes the input feed roller 140 to engage the top substrate 102B of the lower hopper 108 of credential substrates 102 through, for example, an opening in the bottom table member 154. The rotation of the input feed roller 140 in the direction 144 drives the top substrate 102B through the port 114 where it can be received by the transport mechanism 118 for feeding along the processing path 116, as illustrated in FIG. 6. The dual hopper assembly 104 may remain in the second position 134 to feed additional substrates 102 from the stack 112 supported in the lower hopper 108.

Figure 12:
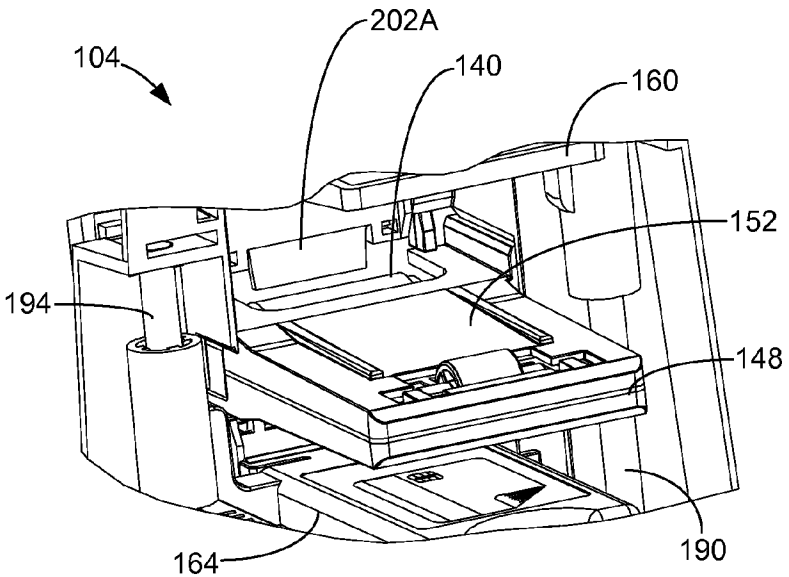
FIG. 12 is an enlarged isometric view of a portion of the dual hopper illustrated in FIG. 11.
Figure 8:
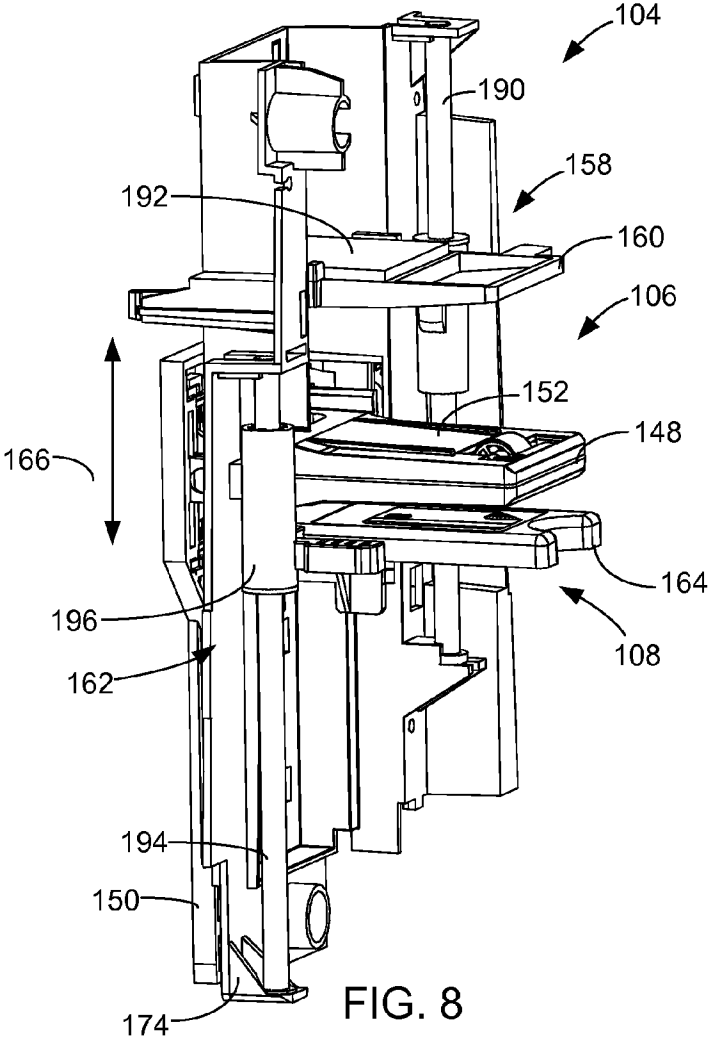
FIG. 8 is an isometric view of a dual hopper assembly in accordance with embodiments of the invention with the outer housing removed.
Figure 9:
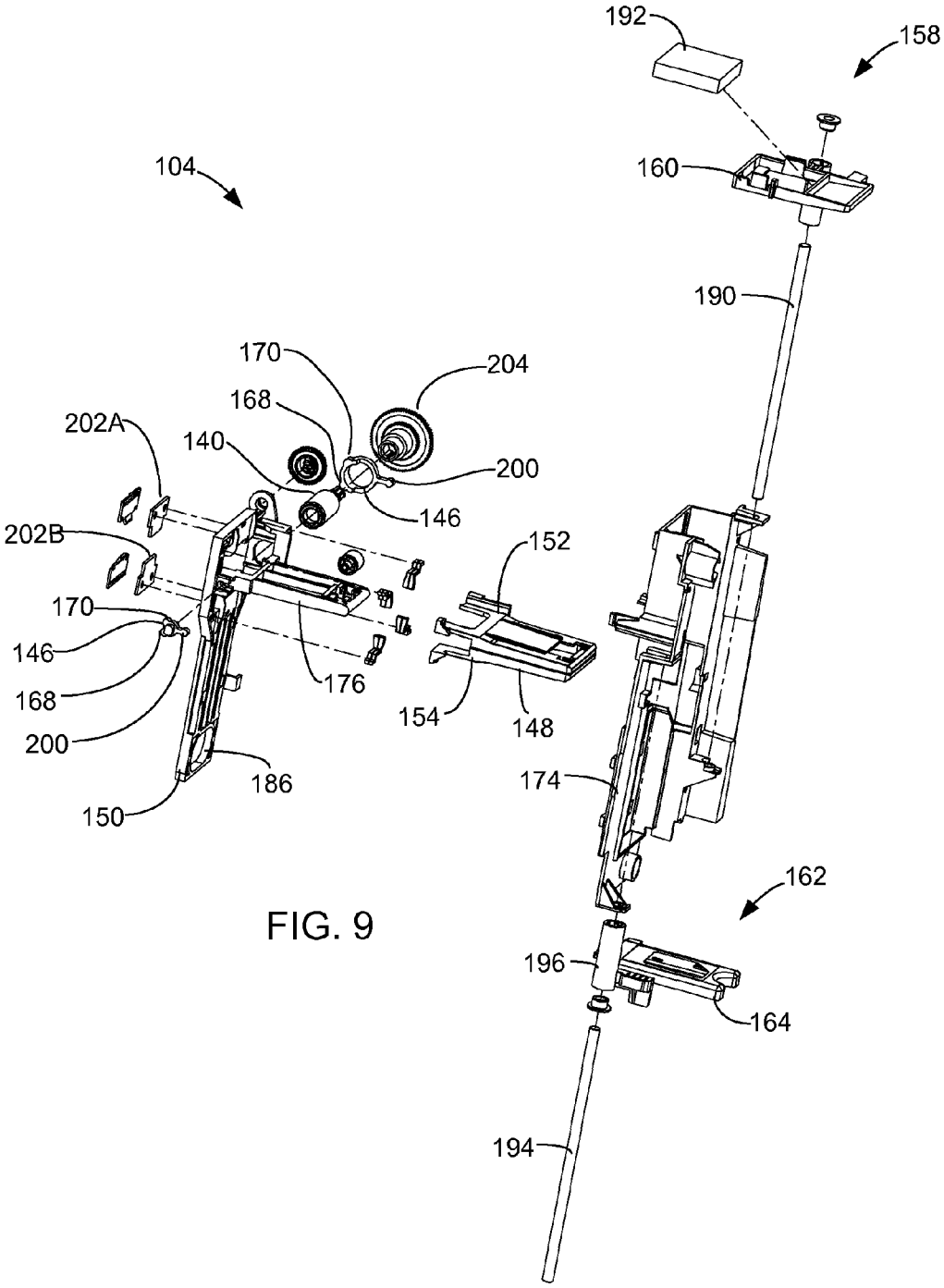
FIG. 9 is an exploded isometric view of the dual hopper assembly of FIG. 8.
Figure 11:
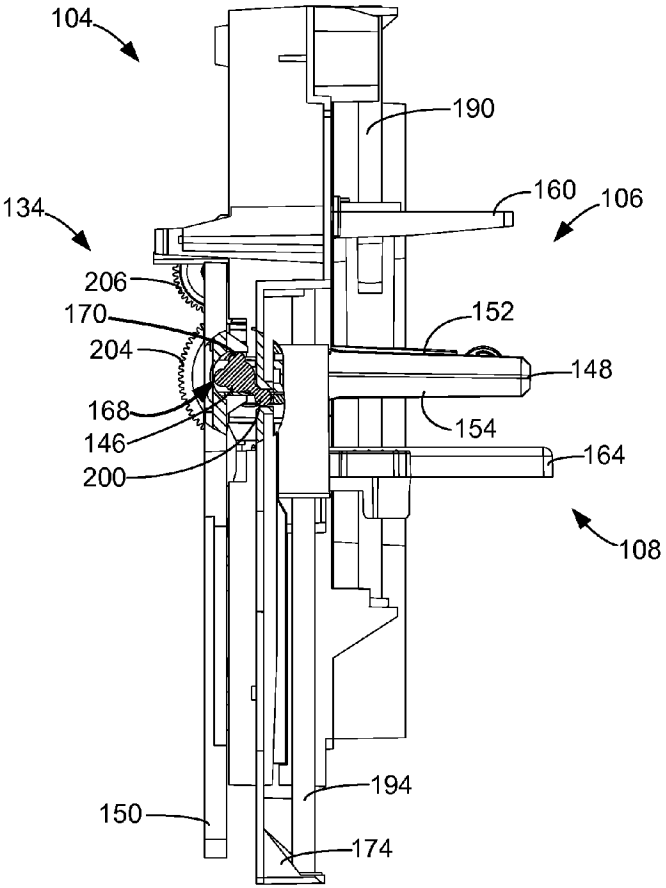
FIG. 11 is a partial cross-sectional view of the of the dual hopper assembly of FIG. 8 in the second position.
Figure 10:
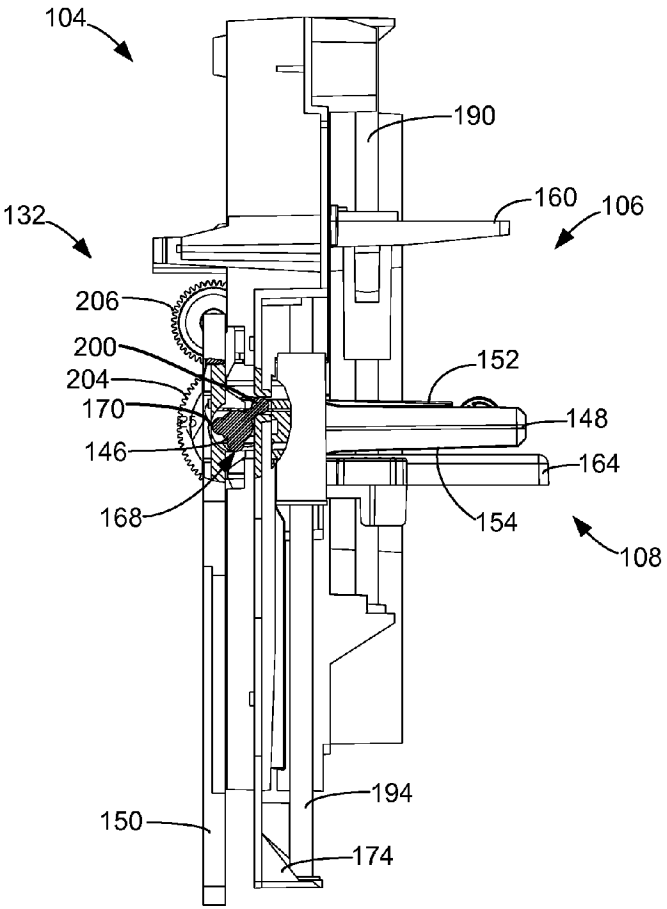
FIG. 10 is a partial cross-sectional view of the of the dual hopper assembly of FIG. 8 in the first position.

FIG. 8 illustrates an isometric view of a dual hopper assembly 104 in accordance with embodiments of the invention with the outer housing removed. FIG. 9 illustrates an exploded isometric view of the dual hopper assembly 104 of FIG. 8. The dual hopper assembly 104 depicted in FIGS. 8 and 9 illustrate a more specific example of an assembly that operates to feed credential substrates from two different input substrate hoppers 104 and 106 using a single input feed roller 140, as described above with reference to FIGS. 4-7. Embodiments of the dual hopper assembly 104 are also illustrated in FIGS. 10-12. FIGS. 10 and 11 are partial cross-sectional views of the of the dual hopper assembly of FIG. 8 in the first and second positions, respectively. FIG. 12 is an isometric view of portions of the dual hopper assembly of FIG. 11. The stacks 110 and 112 are not shown in FIGS. 10-12.

In one embodiment, the dual hopper assembly 104 comprises a main bracket that supports the sliding bracket 150. In on embodiment, the sliding bracket 150 includes components that cooperate with components of the main bracket 174 to allow the sliding bracket 150 to slide in the direction of arrow 166 relative to the main bracket 174. The input feed roller 140, the cams 146, the substrate engaging table 148 and the sliding bracket 150 are configured to move relative to a main bracket 174 to place the dual hopper assembly 104 in the first position 132 or the second position 134. In one embodiment, the input feed roller 140, the cams 146 and the substrate engaging table 148 are all attached to the sliding bracket 150. In one embodiment, the substrate engaging table 148 receives a support table 176 that is attached to the bracket 150, as shown in FIG. 9.

In one embodiment, the dual hopper assembly 104 comprises a motor 180 and a cam 182, shown in FIG. 3. The cam 182 includes a cam surface 184 that engages an interior wall of an opening 186 of the sliding bracket 150. The motor 180 drives rotation of the cam 182 and the cam surface 184 directs the sliding bracket either upward or downward in the direction 166 relative to the main bracket 174 to move the sliding bracket 150 between its first position 132 and the second position 134.

One embodiment of the biasing mechanism 158 comprises a rod 190, along which the member 160 slides. The member 160 is biased toward the table 148 by a weight 192. One embodiment of the biasing mechanism 162 comprises a rod 194, along which the member 164 slides. The member 164 is biased toward the table 148 by a spring 196.

The dual hopper assembly 104 is placed in the first position 132 as discussed above with regard to FIGS. 4 and 5 by moving the sliding bracket 150 downwards along the direction of arrow 166 relative to the main bracket 174. This places the input feed roller 140 generally below the processing path 116. Additionally, the cams 146 are rotated about the axis of rotation of the input feed roller 140 such that the surface 168 of the cams 146 pushes the lower inner surface 169 of the bottom table member 154 of the substrate engaging table 148 downward relative to the input feed roller 140. This downward movement of the bottom table member 154 displaces the lower stack 112 away from the input feed roller 140 and positions the input feed roller 140 in engagement with the bottom substrate 102A of the upper hopper 106, as shown in FIGS. 4 and 5. Feeding of the bottom substrate 102A through the port 114 can then commence.

In one embodiment, the cams 146 are rotatably or pivotally coupled to the bracket 150, such as at an axle of the input feed roller 140, as shown in FIG. 9. In one embodiment, a portion 200 of the cams 146 is attached to the main bracket 174, as shown in FIGS. 10 and 12. As the bracket 150 slides relative to the main bracket 174, the cams 146 rotate or pivot responsively due to the link to the main bracket 174 by the portions 200.

The dual hopper assembly 104 is placed in the second position 134 as discussed above with regard to FIGS. 6 and 7 by moving the sliding bracket 150 upwards along the direction of arrow 166 relative to the main bracket 174. This places the input feed roller 140 generally above the processing path 116, as shown in FIG. 6. Additionally, the cams 146 are rotated or pivoted responsive to the movement of the bracket 150 and the surfaces 170 of the cams 146 push the upper inner surface 172 of the top table member 152 upward relative to the input feed roller 140, as discussed above. This upward movement of the top table member 152 displaces the upper stack 110 of substrates 102 away from the input feed roller 140 and positions the input feed roller 140 in engagement with the top substrate 102B of the lower stack 112, as shown in FIGS. 6 and 7. Feeding of the top substrate 102B through the port 114 can then commence.

In one embodiment, the dual hopper assembly 104 includes a pair of flaps 202A and 202B illustrated in FIG. 9. Flap 202A is positioned above input feed roller 140 on sliding bracket 150, as shown in FIG. 12. Flap 202B is positioned below input feed roller 140 on sliding bracket 150. Flap 202A ensures single card feeding from the upper stack of credential substrates, while flap 202B ensures single card feeding from the lower stack of credential substrates.

In one embodiment, the dual hopper assembly 104 includes a motor for driving the rotation of the input feed roller 140 in the desired direction 142 or 144. In accordance with another embodiment, the input feed roller 140 is driven by the motor 122 of the transport mechanism 118 through a suitable gear train that drives a gear 204 (FIGS. 3, 10 and 11) responsible for directly rotating the input feed roller 140.

In one embodiment, the gear 204 is supported by the sliding bracket 150 and is raised and lowered with the raising and lowering of the sliding bracket 150 and the input feed roller 140. In one embodiment, the gear train of the motor 122 directly engages the gear 204 when the dual hopper assembly 104 is in the second position 134 (FIG. 11) due to the raised position of the sliding bracket 150, and the motor 122 drives the rotation of the gear 204 and the input feed roller 140 in the direction 144 (FIG. 6).

In one embodiment, the dual hopper assembly 104 includes a gear 206 (FIGS. 3, 10 and 11) that engages the gear 204 and is supported by the sliding bracket 150. In one embodiment, the gear 206 directly engages the gear train of the motor 122 when the dual hopper assembly 104 is in the first position due to the lowered position of the sliding bracket 150. The motor 122 drives the rotation of the input feed roller 140 in the direction 142 (FIG. 4) through the gears 206 and 204.

Figure 13:
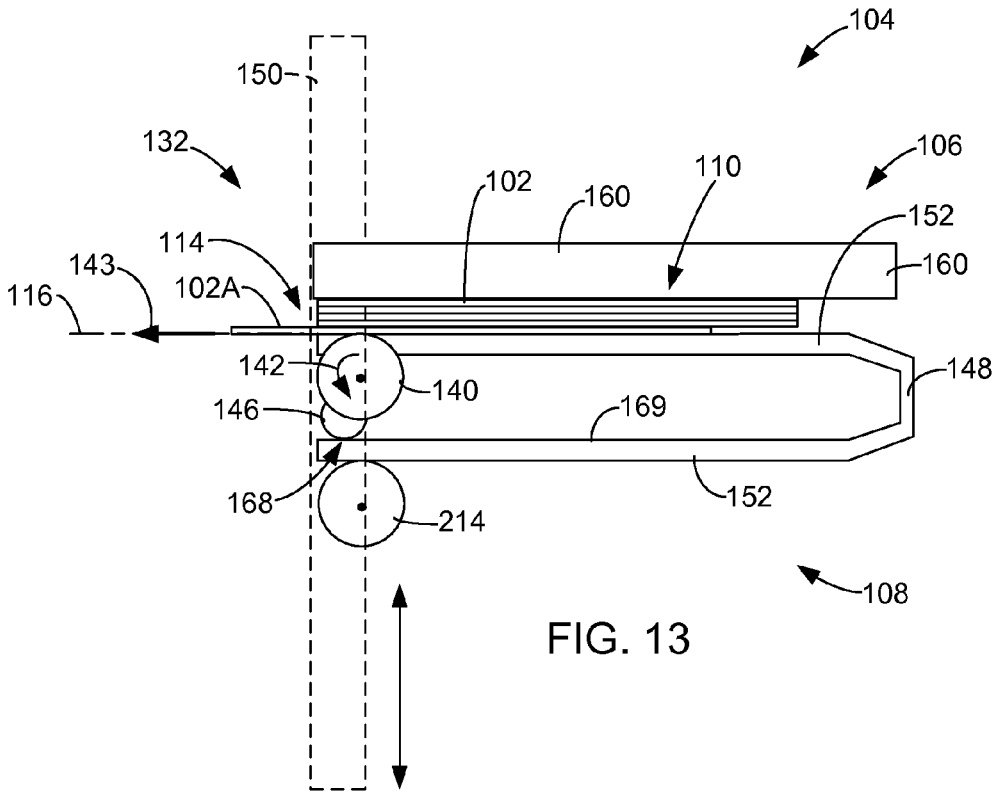
FIG. 13 is a simplified side view of portions of a dual hopper assembly in accordance with embodiments of the invention.
Figure 14:
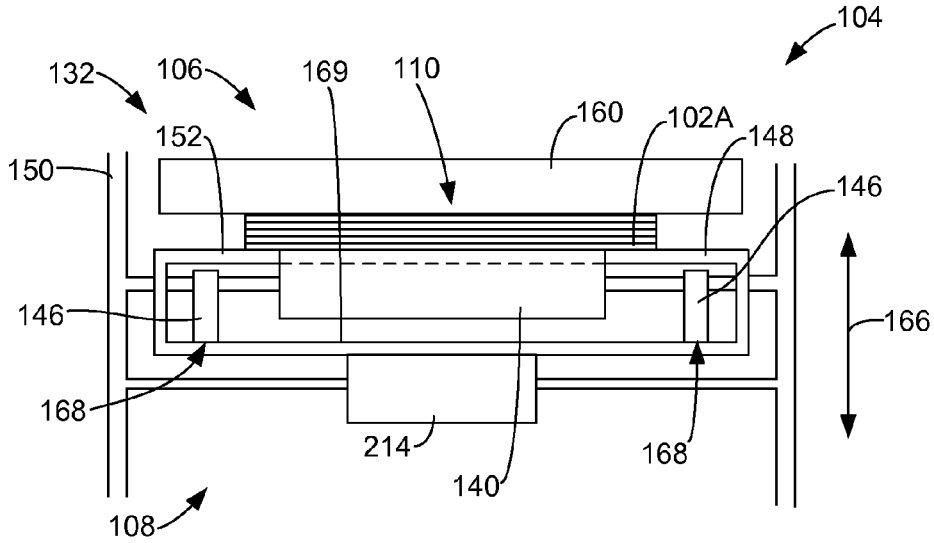
FIG. 14 is a simplified front view of the portions of the dual hopper assembly illustrated in FIG. 13.
Figure 15:
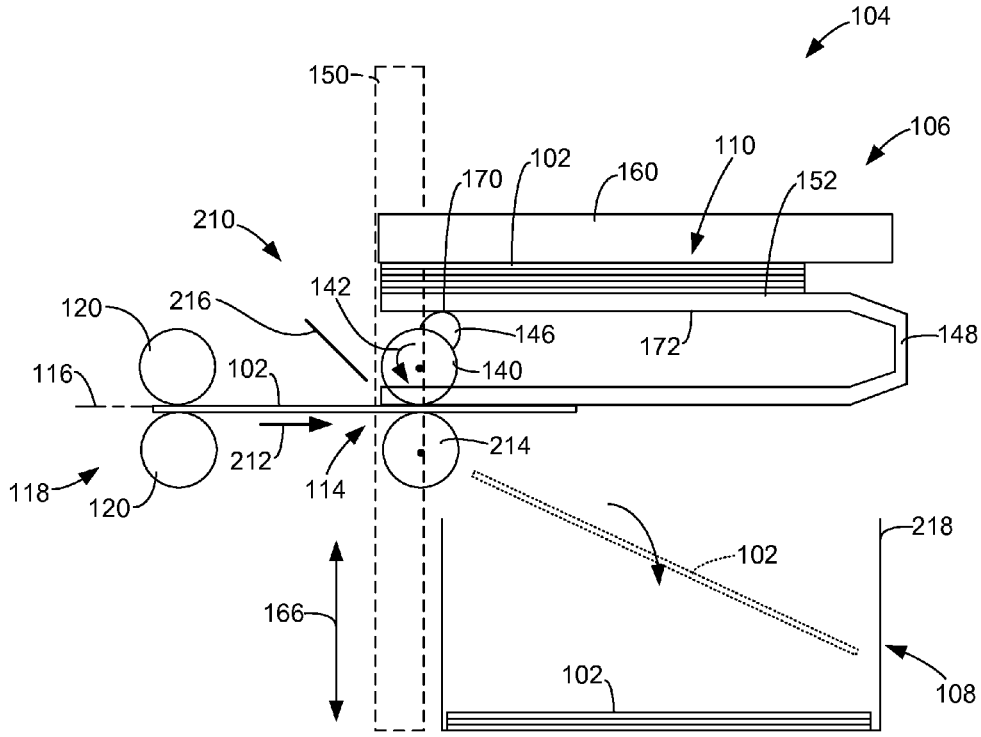
FIG. 15 is a simplified side view of portions of a dual hopper assembly in a second position in accordance with embodiments of the invention.
Figure 16:
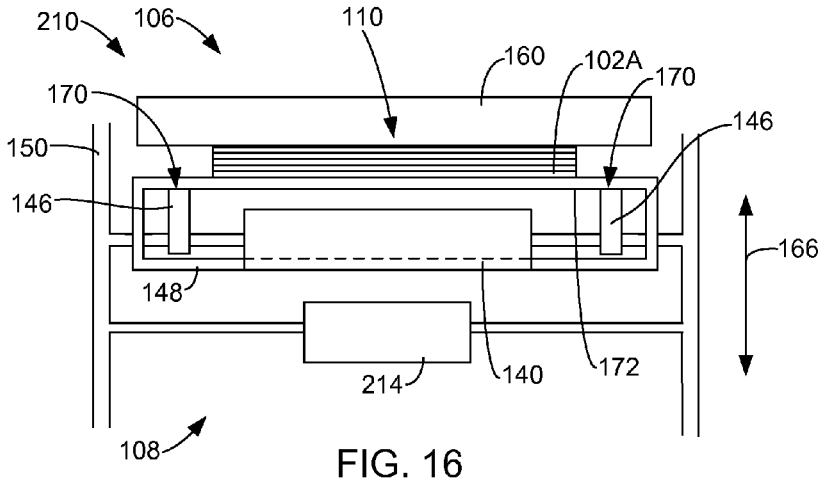
FIG. 16 is a simplified front view of the portions of the dual hopper assembly illustrated in FIG. 15.
Figure 18:
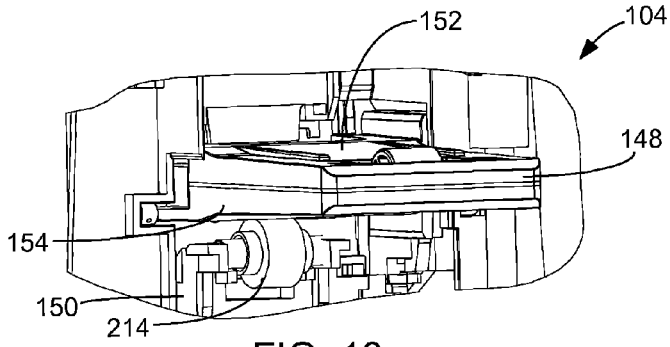
FIG. 18 is an isometric view of a portion of the dual hopper assembly in accordance with embodiments of the invention.
Figure 17:
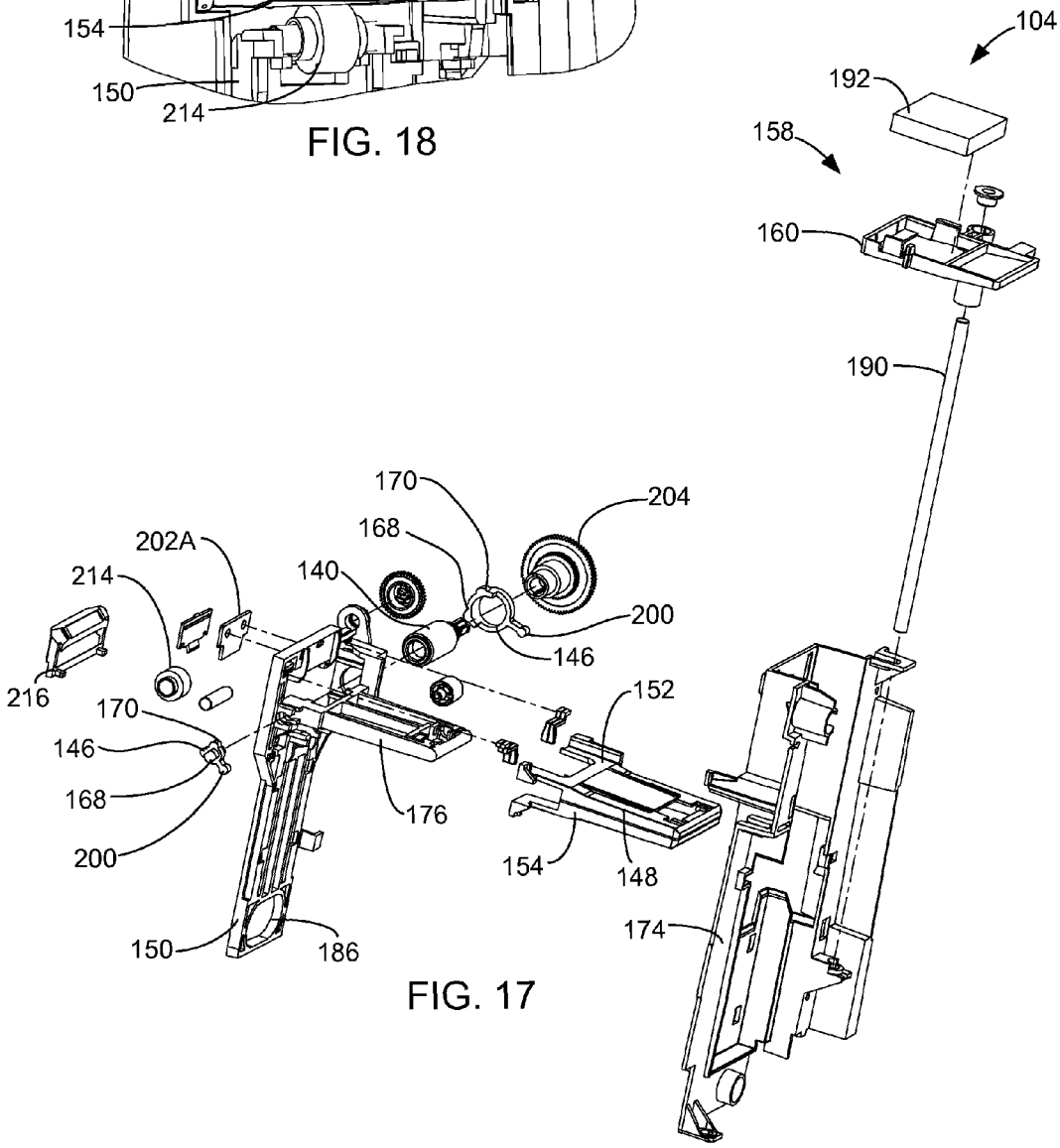
FIG. 17 is an exploded isometric view of the dual hopper assembly in accordance with embodiments of the invention.

As mentioned above, the dual hopper assembly 104 may be configured to feed substrates 102 from the upper stack 110 of substrates 102 contained in the upper hopper 106, while allowing substrates 102 to be discharged from the processing path 116 and through the port 114 for collection in the lower hopper 108. This embodiment will generally be described with reference to FIGS. 13-18. FIGS. 13 and 14 respectively are simplified side and front views of portions of the dual hopper assembly 104 in a first position 132 in accordance with embodiments of the invention. FIGS. 15 and 16 respectively are simplified side and front views of portions of the dual hopper assembly 104 in a substrate collecting position 210 in accordance with embodiments of the invention. FIG. 17 is an exploded isometric view of the dual hopper assembly 104 in accordance with embodiments of the invention. FIG. 18 is an isometric view of an assembled portion of the dual hopper assembly 104 illustrated in FIG. 17.

The first position 132 of the dual hopper assembly illustrated in FIGS. 13 and 14 positions the input feed roller 140 in engagement with the bottom substrate 102A of the upper hopper 106, substantially in accordance with the embodiments described above. For instance, the sliding bracket 150, the input feed roller 140 and the table 148 are raised to place the top side of the input feed roller 140 proximate the processing path 116, or to at least position a majority of the input feed roller 140 below the processing path 116. In one embodiment, the input feed roller 140 engages the bottom substrate 102A of the stack 110 in the upper hopper 106. In one embodiment, the dual hopper assembly 104 includes the cams 146, which are rotated to direct the bottom table member 154 of the table 148 downward and position the input feed roller 140 in contact with the bottom substrate 102A of the hopper 106. The bottom substrate 102A may be fed through the port 114 by the input feed roller 140 and along the processing path 116 in the direction 143, as discussed above.

When it is desired to collect substrate 102 that has been processed by the one or more processing components 124 of the device 100, the feed rollers 120 of the transport mechanism 118 feed the processed substrate 102 along the processing path 116 toward the port 114, as indicated by arrow 212 in FIG. 15. In one embodiment, the dual hopper assembly 104 is shifted into the collecting position 210 by raising the input feed roller 140, the cams 146, the substrate engaging table 148 and the sliding bracket 150 relative to the processing path 116, as occurs when the dual hopper assembly 104 is moved to the second position 134. Also, in accordance with one embodiment, the cams 146 rotate to displace the top table member 170 away from the input feed roller 140 and to place the input feed roller proximate the processing path 116. In one embodiment, the input feed roller 140 is raised such that a majority of the input feed roller is above the processing path 116, as shown in FIG. 15.

In one embodiment, the dual hopper assembly 104 also includes a roller 214 (FIGS. 13-18) that forms a pinch roller pair with the input feed roller 140. The collecting position 210 places the gap between the input feed roller 140 and the idler roller 214 in line with the processing path 116 and the port 114. In one embodiment, the dual hopper assembly 104 includes a guide 216, shown in FIGS. 15 and 17, that is attached to the bracket 150 and directs processed credential substrates 102 fed by the transport mechanism 118 through the port 114 and between the input feed roller 140 and the roller 214. In one embodiment, the input feed roller 140 rotates in the direction of arrow 142 (FIG. 15) to discharge the processed substrates 102 into a lower hopper 218, as shown in FIG. 15.

Although the present invention has been described with reference to preferred embodiments, workers skilled in the art will recognize that changes may be made in form and detail without departing from the spirit and scope of the invention.

What is claimed is:

1. A dual hopper assembly for use in a credential processing device comprising:

an upper hopper configured to support one or more card substrates;

a lower hopper configured to support one or more card substrates; and an input feed roller between the upper and lower hoppers, and movable between a first position, in which the input feed roller engages a bottom substrate supported in the upper hopper, and a second position, in which the input feed roller is displaced from the bottom substrate;

wherein rotation of the input feed roller is driven in a first direction when the input feed roller is in the first position, and rotation of the input feed roller is driven in a second direction, which is opposite the first direction, when the input feed roller is in the second position.

2. The assembly of claim 1, wherein the input feed roller engages a top substrate supported in the bottom hopper when in the second position.

3. The assembly of claim 2, further comprising:

a main bracket; and a sliding bracket supported by the main bracket, the sliding bracket slides relative to the main bracket and supports the input feed roller;

wherein the sliding bracket has a first position relative to the main bracket that corresponds to the first position of the input feed roller, and a second position relative to the main bracket that corresponds to the second position of the input feed roller.

4. The assembly of claim 3, further comprising a motor and a cam, the motor drives rotation of the cam, the cam comprising a cam surface that directs movement of the sliding bracket relative to the main bracket responsive to rotation of the cam.

5. The assembly of claim 3, further comprising:

a cam supported by the sliding bracket for rotation about an axis; and the cam having a first position corresponding to the first positions of the sliding bracket and the input feed roller, and a second position corresponding to the second positions of the sliding bracket and the input feed roller;

wherein the cam directs the top substrate away from the input feed roller when the cam is in the first position, and the cam directs the bottom substrate away from the input feed roller when the cam is in the second position.

6. The assembly of claim 5, further comprising a substrate engaging table that engages the top and bottom substrates, wherein the cam moves the table relative to the input feed roller responsive to rotation of the cam about the axis.

7. A credential processing device comprising:

a transport mechanism that feeds individual card substrates along a processing path;

a processing component that performs a process on card substrates fed by the transport mechanism; and a dual hopper assembly comprising:

an upper hopper configured to support one or more card substrates;

a lower hopper configured to support one or more card substrates; and an input feed roller between the upper and lower hoppers and movable between first and second positions relative to the processing path;

wherein the input feed roller is configured to feed a bottom substrate supported in the upper hopper along the processing path when in the first position, and the input feed roller is displaced from the bottom substrate and is configured to feed a top substrate supported in the bottom hopper along the processing path when in the second position.

8. The device of claim 7, wherein:

a majority of the input feed roller lies below the processing path when the input feed roller is in the first position; and a majority of the input feed roller lies above the processing path when the input feed roller is in the second position.

9. The device of claim 7, wherein rotation of the input feed roller is driven in a first direction when the input feed roller is in the first position, and rotation of the input feed roller is driven in a second direction, which is opposite the first direction, when the input feed roller is in the second position.

10. The device of claim 7, wherein the dual hopper assembly further comprises:

a main bracket; and a sliding bracket supported by the main bracket, the sliding bracket slides relative to the main bracket and supports the input feed roller;

wherein the sliding bracket has a first position relative to the main bracket that corresponds to the first position of the input feed roller, and a second position relative to the main bracket that corresponds to the second position of the input feed roller.

11. The device of claim 10, wherein the dual hopper assembly further comprises a motor and a cam, the motor drives rotation of the cam, the cam comprising a cam surface that directs movement of the sliding bracket relative to the main bracket responsive to rotation of the cam.

12. The device of claim 10, wherein the dual hopper assembly further comprises:

a cam supported by the sliding bracket for rotation about an axis; and the cam having a first position corresponding to the first positions of the sliding bracket and the input feed roller, and a second position corresponding to the second positions of the sliding bracket and the input feed roller;

wherein the cam directs the top substrate away from the input feed roller when the cam is in the first position, and the cam directs the bottom substrate away from the input feed roller when the cam is in the second position.

13. The device of claim 7, wherein:

the transport mechanism comprises a plurality of feed rollers and a motor configured to drive the rotation of the feed rollers; and the motor drives the rotation of the input feed roller.

14. A method comprising:

providing a credential processing device comprising:

a transport mechanism configured to feed individual card substrates along a processing path;

a processing component configured to perform a process on card substrates fed by the transport mechanism; and a dual hopper assembly comprising;

an upper hopper supporting one or more card substrates;

a lower hopper; and an input feed roller;

lowering the input feed roller relative to the processing path to a first position, in which the input feed roller engages a bottom substrate supported in the upper hopper;

feeding the bottom substrate along the processing path using the input feed roller;

raising the input feed roller relative to the processing path to a second position, in which the input feed roller engages a top substrate supported in the lower hopper; and feeding the top substrate along the processing path using the input feed roller.

15. The method of claim 14, further comprising:

feeding the top substrate along the processing path using the transport mechanism; and processing the top substrate using the processing component.

16. A credential processing device comprising:

a transport mechanism that feeds individual card substrates along a processing path;

a processing component that performs a process on card substrates fed by the transport mechanism; and a dual hopper assembly comprising:

an upper hopper comprising a substrate table, which is configured to support one or more card substrates;

a lower hopper; and a feed roller between the upper and lower hoppers;

wherein the substrate table is movable relative to the processing path between a first position in which a bottom substrate supported on the table engages the feed roller and is discharged from the upper hopper, and a second position in which the substrate table is raised relative to the first position and substrates fed from the processing path toward the dual hopper assembly are received in the lower hopper.

17. The credential processing device of claim 16, wherein the feed roller is movable relative to the processing path between a first position in which the feed roller engages the bottom substrate supported on the substrate table, and a second position in which the feed roller is raised relative to the first position of the feed roller.

18. The credential processing device of claim 17, wherein a majority of the feed roller is located below the processing path when the feed roller is in the first position, and a majority of the feed roller is located above the processing path when the feed roller is in the second position.

19. The credential processing device of claim 18, wherein substrates fed along the processing path toward the dual hopper assembly are driven into the lower hopper by the feed roller when the feed roller is in the second position.

* * * * *